US007862252B2

(12) United States Patent
Gelfand et al.

(10) Patent No.: US 7,862,252 B2
(45) Date of Patent: Jan. 4, 2011

(54) VEHICLE BARRIER SYSTEM

(75) Inventors: Matthew A. Gelfand, Brentwood, TN (US); Brad Grubb, White House, TN (US); Jon Jackson, Fairview, TN (US)

(73) Assignee: Universal Safety Response, Inc., Franklin, TN (US)

( * ) Notice: Subject to any disclaimer, the term of this patent is extended or adjusted under 35 U.S.C. 154(b) by 1095 days.

(21) Appl. No.: 11/402,093

(22) Filed: Apr. 10, 2006

(65) Prior Publication Data

US 2007/0237577 A1 Oct. 11, 2007

(51) Int. Cl.
*E01F 13/08* (2006.01)

(52) U.S. Cl. ..... 404/6; 404/9; 49/49; 256/1; 256/13.1

(58) Field of Classification Search ..... 404/6, 404/9, 10; 256/13.1; 49/34, 49
See application file for complete search history.

(56) References Cited

U.S. PATENT DOCUMENTS

| | | | | | |
|---|---|---|---|---|---|
| 353,368 | A * | 11/1886 | Miller | 49/93 |
| 2,007,071 | A * | 7/1935 | Burns | 49/131 |
| 4,333,268 | A | 6/1982 | Dumbeck | |
| 4,844,653 | A * | 7/1989 | Dickinson | 404/6 |
| 5,146,710 | A * | 9/1992 | Caldwell | 49/35 |
| 5,228,237 | A * | 7/1993 | Nasatka | 49/49 |
| 5,245,787 | A | 9/1993 | Swenson et al. | |
| 5,639,178 | A * | 6/1997 | Wilson et al. | 404/6 |
| 5,871,329 | A * | 2/1999 | Tidrick et al. | 414/537 |
| 6,179,517 | B1 * | 1/2001 | Nelson | 404/6 |
| 6,189,839 | B1 | 2/2001 | Lemieux | |
| 6,485,225 | B1 * | 11/2002 | Baker | 404/6 |
| 6,655,090 | B2 | 12/2003 | Regner | |
| 6,902,151 | B1 * | 6/2005 | Nilsson | 256/13.1 |
| 7,374,362 | B1 | 5/2008 | Metzger | |
| 7,641,416 | B2 | 1/2010 | Miracle | |
| 2003/0222254 | A1 * | 12/2003 | Bergendahl | 256/13.1 |
| 2005/0220536 | A1 * | 10/2005 | Blair et al. | 404/6 |
| 2007/0040405 | A1 * | 2/2007 | Coble et al. | 296/61 |
| 2008/0075529 | A1 | 3/2008 | Gelfand et al. | |

FOREIGN PATENT DOCUMENTS

| | | |
|---|---|---|
| WO | 2004/101893 | 11/2004 |
| WO | WO 2008/039336 | 4/2008 |

OTHER PUBLICATIONS

International Search Report, Apr. 3, 2008 (PCT).

* cited by examiner

*Primary Examiner*—Raymond W Addie

(57) ABSTRACT

A vehicle barrier system. The vehicle barrier system includes a base, an arm hingably mechanically coupled to the base, a raising/lowering mechanism in mechanical communication with the arm, and a cable supported by the arm, the cable mechanically coupled to first and second anchors placed on opposite sides of an area through which a vehicle may pass, and the raising/lowering mechanism moves the arm and the cable between a first position and a second position.

26 Claims, 22 Drawing Sheets

VEHICLE BARRIER SYSTEM

BACKGROUND

This invention relates to a vehicle barrier system that may be used to stop a moving vehicle in a variety of applications, including traffic control, drawbridges, rail crossings, security gates, off-road, and crash cushion applications. While the vehicle barrier system of the present disclosure may be installed permanently, the arrangement of the vehicle barrier system of the present disclosure may facilitate assembly/disassembly and portability. The vehicle barrier system of the present disclosure may be used with a variety of anchors, such as nearby buildings or vehicles, such as trucks.

SUMMARY OF THE DISCLOSURE

The present disclosure relates to a vehicle barrier system. In one aspect, the vehicle barrier system includes a base, an arm hingably mechanically coupled to the base, a raising/lowering mechanism in mechanical communication with the arm, and a cable supported by the arm, the cable mechanically coupled to first and second anchors placed on opposite sides of an area through which a vehicle may pass, and the raising/lowering mechanism moves the arm and the cable between a first position and a second position.

DETAILED DESCRIPTION OF THE PREFERRED EMBODIMENTS

As used herein, the term absorb may mean to absorb, disperse, dissipate or redirect energy.

It may be understood that components in the system of the present disclosure may be fabricated using metal or similar strength material, including, but not limited to, polymers, elastomers, composites or other engineered materials.

Figure 1A:
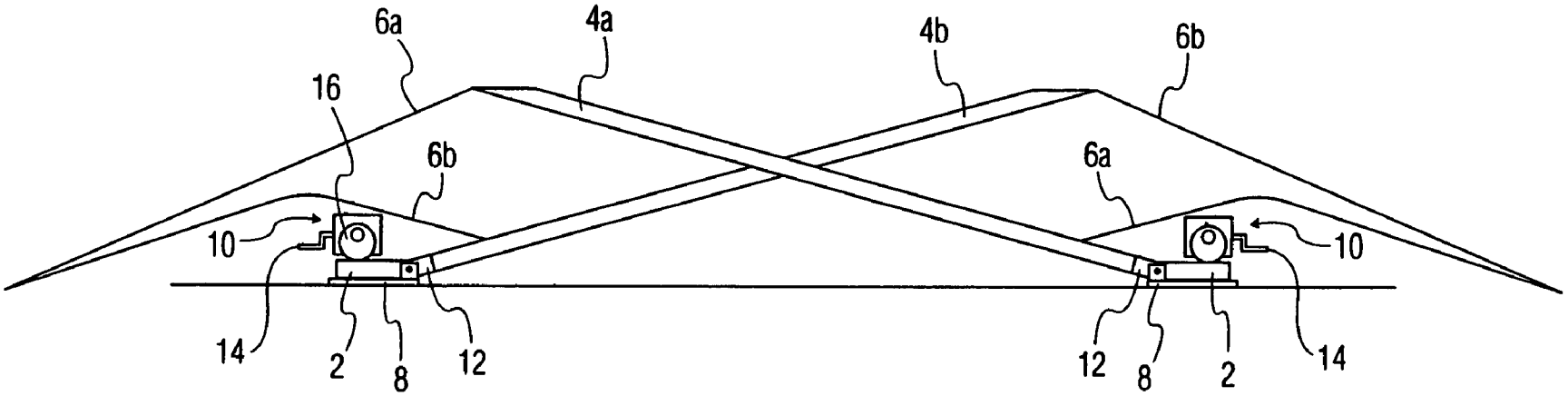
FIGS. 1A and 1B show front views of a vehicle barrier system, in raised and lowered positions, respectively, according to a first aspect of the present disclosure.
Figure 1B:
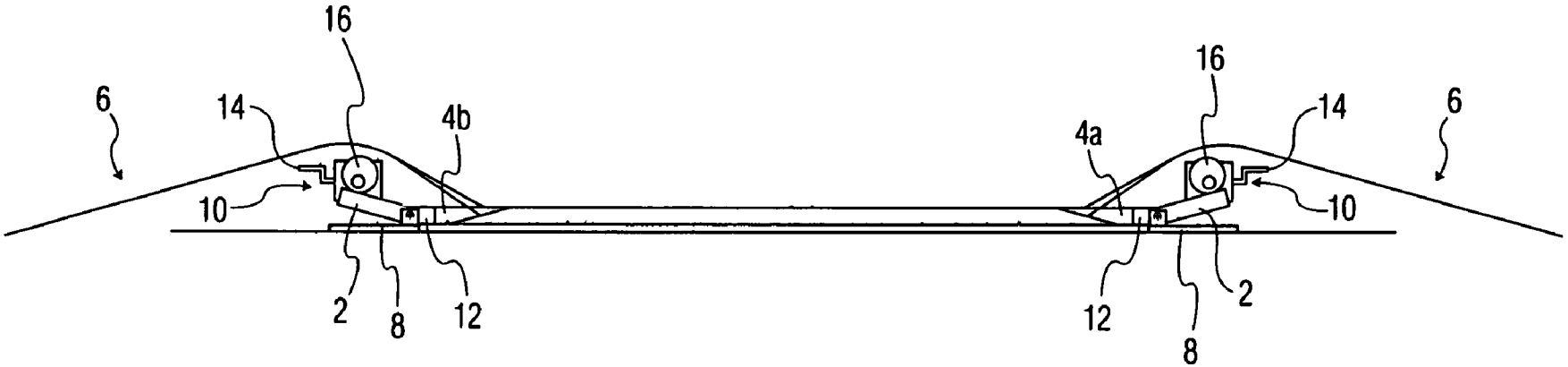

Referring to the drawings, wherein like reference numerals represent identical or corresponding parts throughout the several views, and more particularly to FIGS. 1A and 1B, front views of a vehicle barrier system, according to a first aspect of the present disclosure are shown. In a first aspect, the vehicle barrier system may include at least arms 2, arm extensions 4*a* and 4*b*, cables 6*a* and 6*b*, bases 8, raising/lowering mechanisms 10, and anchors 70 (shown in FIG. 9).

Each raising/lowering mechanism 10 may include cam 16 in mechanical communication with arm 2. Raising/lowering mechanisms 10 may be operated by turning handles 14, which may cause cams 16 to rotate and arms 2 to approach bases 8, thereby raising arm connections 12, arm extensions 4*a* and 4*b*, and cables 6*a* and 6*b* as shown in FIG. 1A. When in a raised position, arm extensions 4*a* and 4*b* and cables 6 and 6*b* may be high enough to encounter a front of a vehicle.

Similarly, turning handles 14 may cause cams 16 to rotate further and cause arms 2 to move away from bases 8, thereby lowering arm connections 12, arm extensions 4*a* and 4*b*, and cables 6*a* and 6*b* as shown in FIG. 1B. When in lowered position, arm extensions 4*a* and 4*b* may be substantially horizontal and/or parallel to ground level and low enough that a vehicle may pass over it using ramps 40 (shown in FIG. 9) in a manner similar to a speed bump. In another aspect, arm extensions 4*a* and 4*b* may be embedded at or below ground level and ramps 40 may not be used.

Arm extensions 4*a* and 4*b* may extend at least partially across a roadway and may support cables 6*a* and 6*b*, which may span the roadway. In FIGS. 1A and 1B, cable 6*a* may be supported by arm 4*a*, while cable 6*b* may be supported by arm 4*b*. Cables 6 may be fabricated from steel (wire rope) or segmented-rigid components, such as linked bar.

Bases 8 may be arranged on opposite sides of a roadway and, when in a raised position, arm extensions 4*a* and 4*b* may form an 'X' shape and may be mechanically coupled for example, using a linear slide, pin, groove, ring or other connector (not shown).

Figure 2:
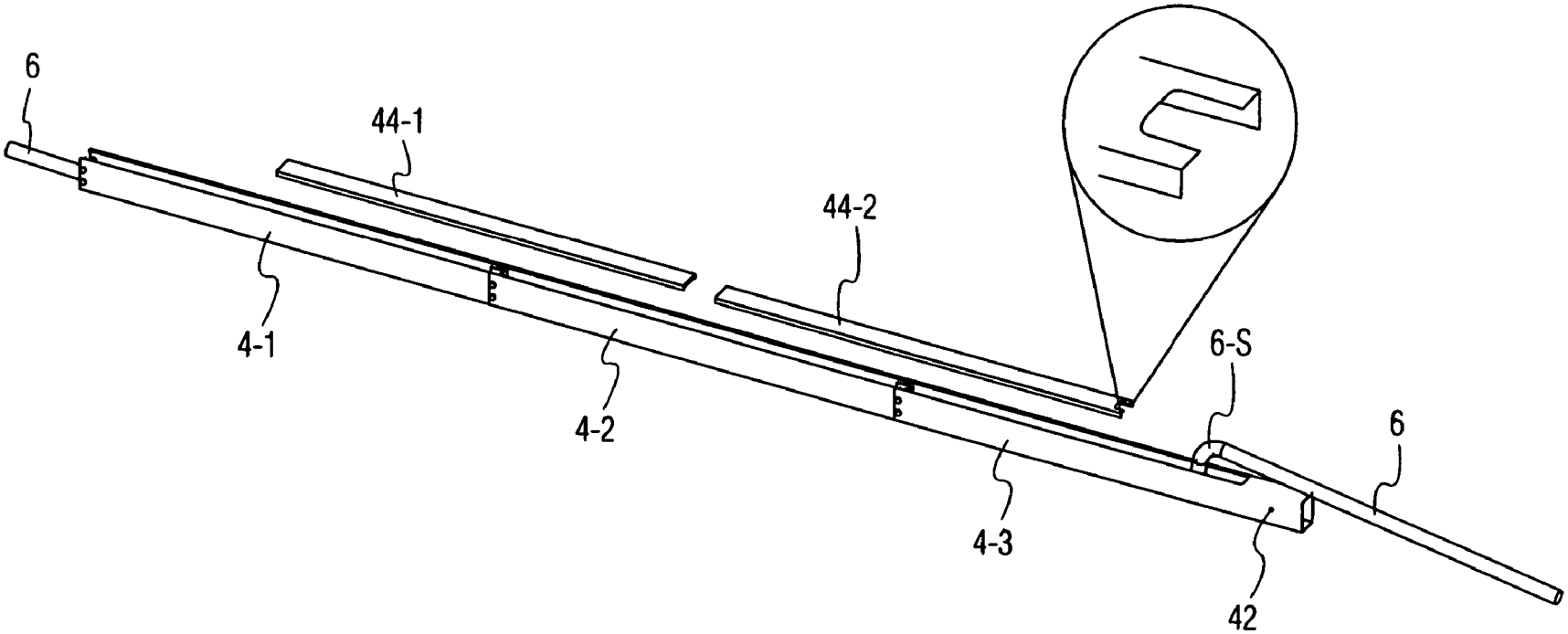
FIGS. 2 and 3 show perspective views of segmented arm extensions according to an aspect of the present disclosure.
Figure 3:
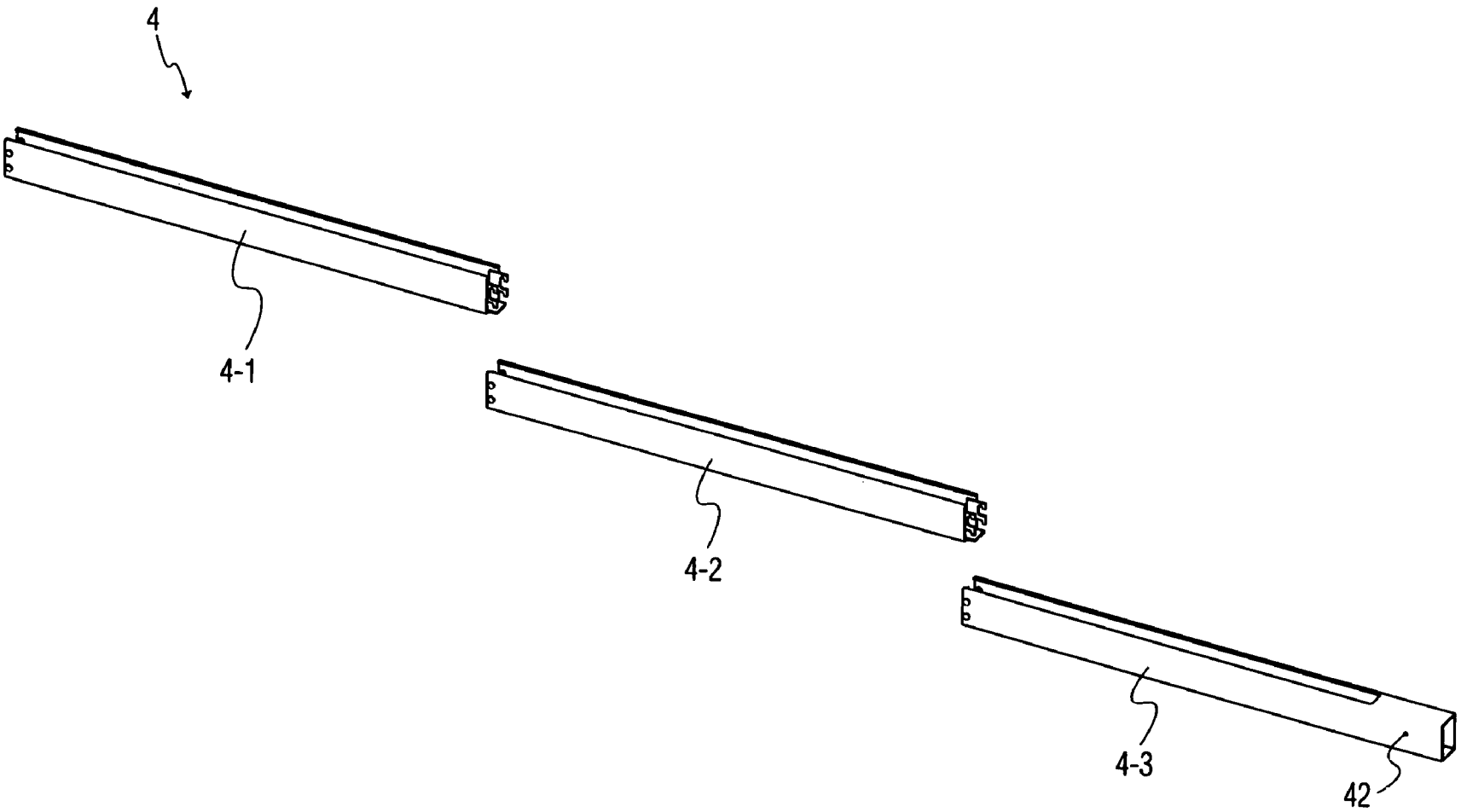

As shown in FIGS. 2 and 3, arm extensions 4 may be formed of interlocking segments 4-1, 4-2 and 4-3, which may be disassembled for storage or transport. Arm extensions 4 may be fabricated of expanded metal, or plastic, such as PVC. At least a portion of arm extensions 4 may be hollow and some portion of cables 6 may be stored inside the hollow portion of arm extensions 4. To facilitate placing cables 6 inside arm extensions 4, at least part of arm extensions 4 may be left open. Arm extension cap 44 may be used to cover an open portion of arm extensions 4. Arm extension cap 44 may be formed of segments 44-1 and 44-2, which may be longer than arm extension segments 4-1, 4-2, and 4-3, so that arm extension cap segments 44-1 and 44-2 may extend over interlocking points of arm extension segments 4-1, 4-2, and 4-3. In order to protect cable 6, the portion of cable 6 that exits arm extension 4-3 may be protected by a sheath 6-S. In another aspect, arm extension cap segment 44-2 located closest to base 8 may have a cutout to allow cable 6 to exit arm extension segment 4-3.

In another aspect, arm extensions 4 may be segmented and arm extension segments 44 may be hinged and folded or may be telescoping.

Figure 4:
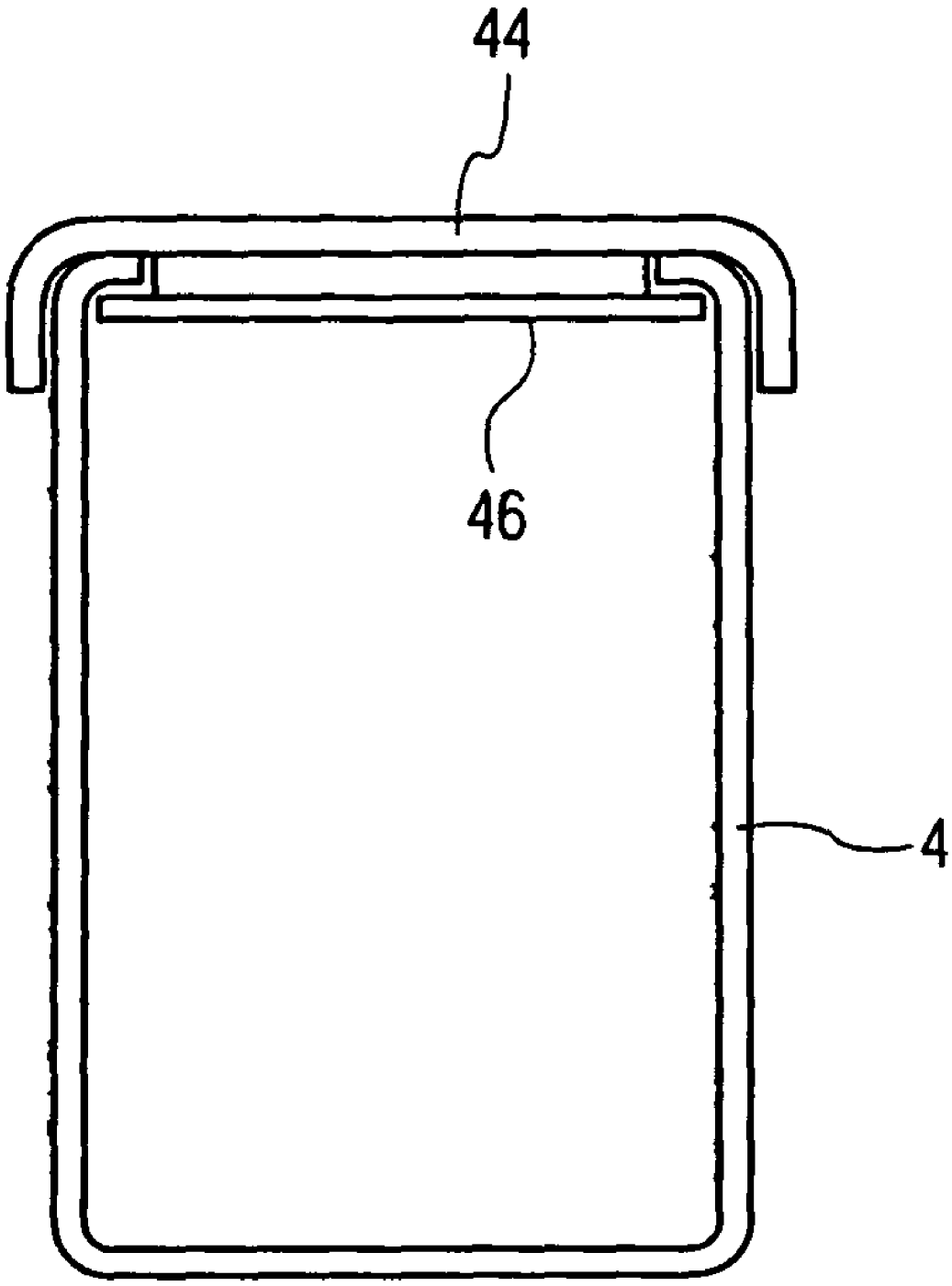
FIG. 4 shows a cross section of arm extension and arm extension cap according to an aspect of the present disclosure.

FIG. 4 shows a cross-section view of arm extension 4 and arm extension cap 44. Arm extension cap 44 may have a lip 46 that may assist arm extension cap 44 in sliding on to arm extension 4 and may provide structural reinforcement to arm extension 4. Such structural reinforcement may be useful in the event the system is in a lowered position and a vehicle passes over and compresses arm extension 4.

In one aspect, space within the hollow portion of arm extensions 4 not occupied by cables 6 may be filled with foam. In another aspect, arm extensions 4 may have external clips or rings which support cables 6.

Figure 5:
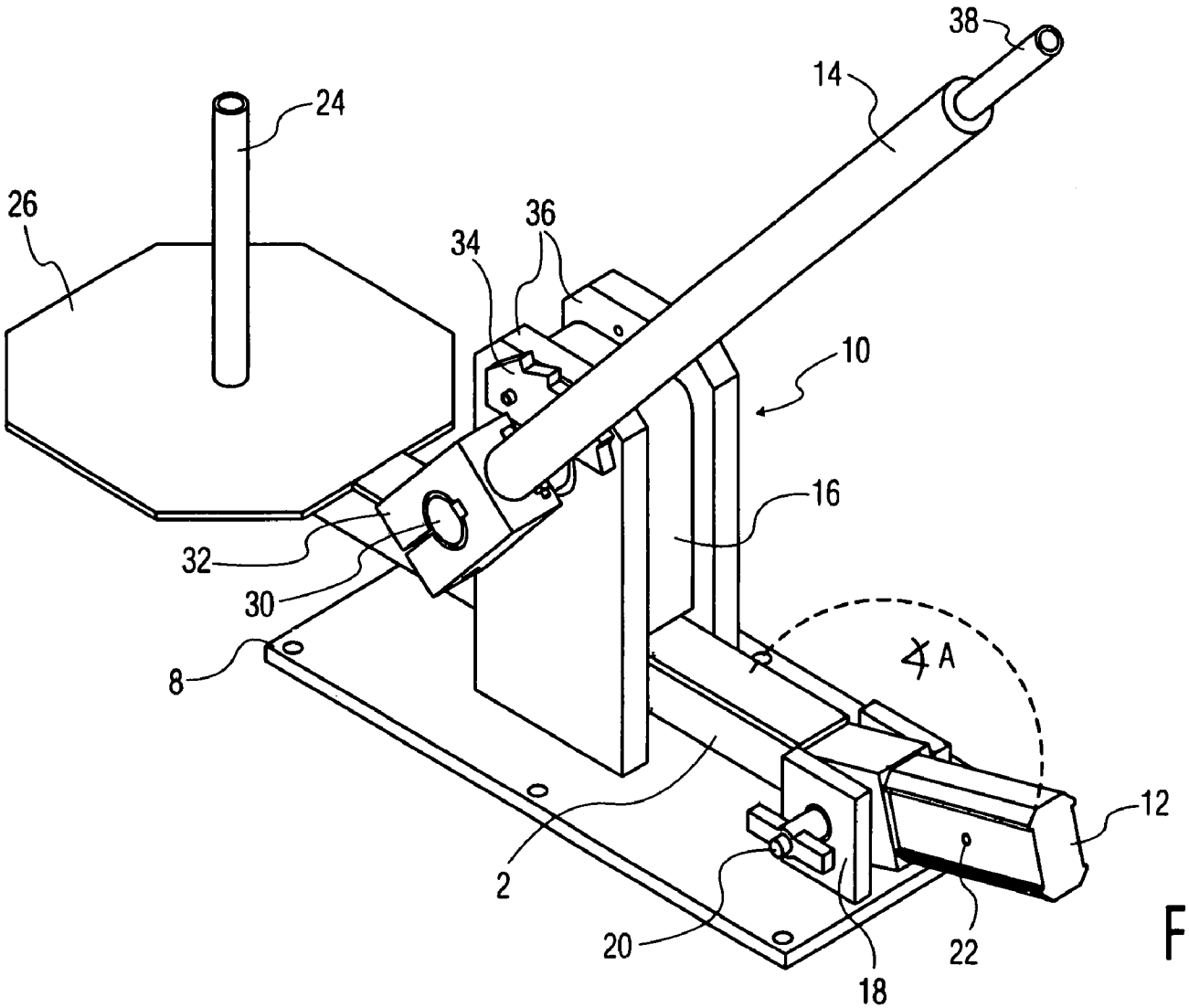
FIG. 5 shows a perspective view of base and arm with counterbalance and raising/lowering mechanism according to an aspect of the present disclosure.

FIG. 5 shows a perspective views of a base and arm with counterbalance and raising/lowering mechanism according to an aspect of the present disclosure. Arm 2 may be mechanically coupled to base 8 at base joint 18 using pin 20. Arm connection 12 may be arranged at angle A to arm 2. In one aspect, angle A may be 165 degrees. Arm extension 4*b* (see FIGS. 6A and 6B) may be mechanically coupled to arm connection 12 and may be secured by placing pin 28 through hole 22 of arm connection 12 and hole 42 (shown in FIG. 2) of arm extension 4*b*. Pin 28 may be a shear pin or other frangible connector selected to break upon application of a predetermined threshold force, such as when arm extension 4*b* is impacted by a vehicle.

In another aspect, arm 2 and arm extension 4 may be replaced by a similarly shaped single arm, for example, a unified tube of metal, that may not be separable. In yet another aspect, arm 2 and arm extension 4 may be a replaced by a similarly shaped single arm that may be separated upon application of a predetermined threshold force. Such separation may be encouraged by weakening or scoring a portion of the single arm, for example, near a position corresponding to hole 22 in the aspect shown in FIG. 5.

Returning to FIG. 5, arm 2 may include counterbalance post 24 and counterbalance platform 26 for holding counterweights that may offset the weight of and thereby facilitate raising and lowering arm extensions 4, cables 6, and any additional arms, cables or attachments thereto. In one aspect, counterweights may be containers filled with sand or water.

As shown in FIG. 5, raising/lowering mechanism 10 may include risers 36 supporting shaft 30 mechanically coupled to cam 16. Shaft 30 may be mechanically coupled to handle 14 with block 32. Shaft 30 may transfer force from handle 14 to arm 2 via cam 16, which may be shaped to respond to constant force when raising the system, for example, cam 16 may be formed in an eccentric shape. Ratchet catch 34 may hold cam 16 in place at predetermined positions, for example, raised, intermediate, and lowered. Ratchet catch 34 may be locked into place and/or released by actuator 38 in mechanical communication therewith. Actuator 38 may be a hand depressed lever and may release a catch block (not shown) from ratchet catch 34 thus allowing free motion of handle 14.

Figure 6A:
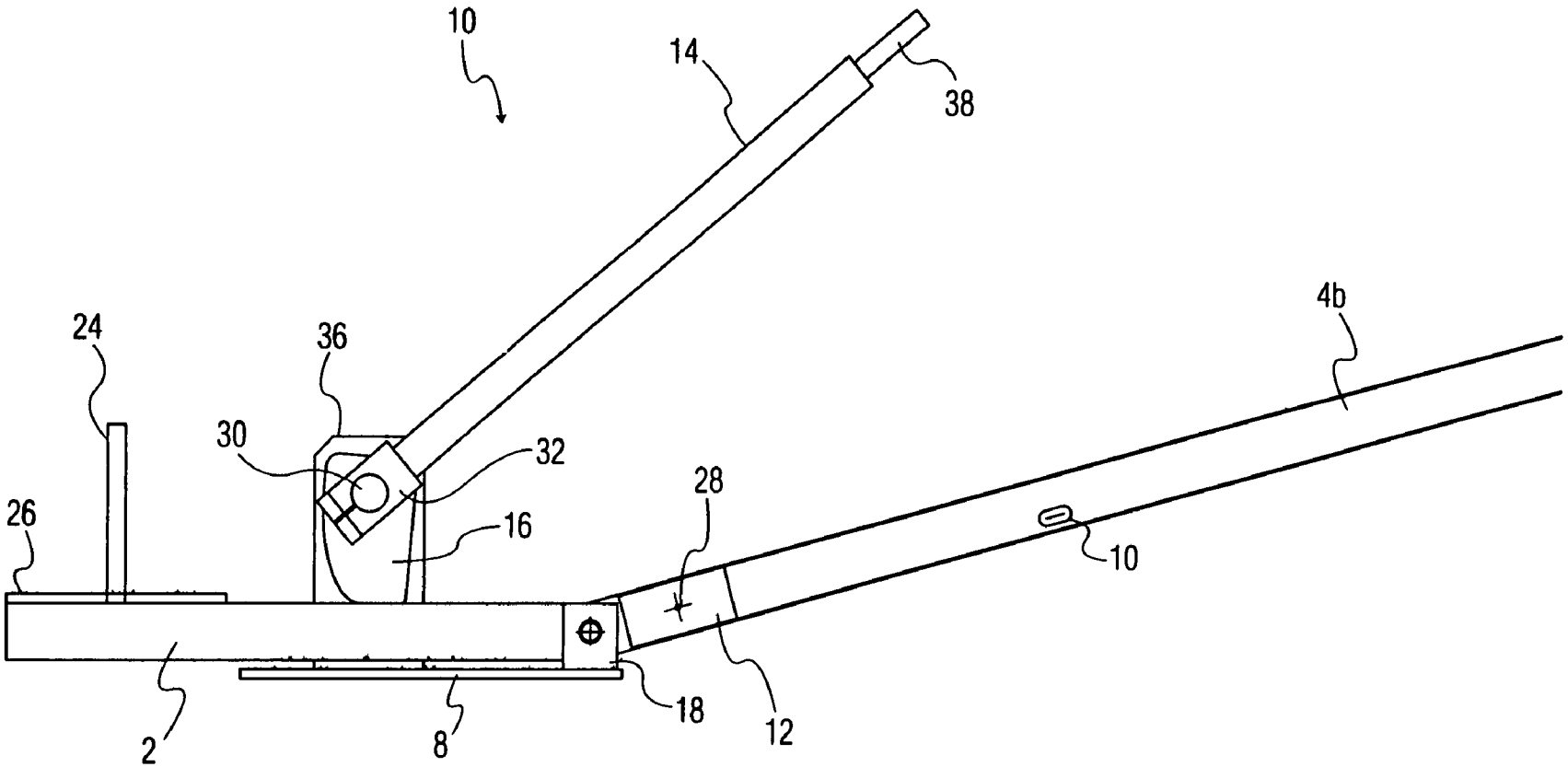
FIGS. 6A and 6B show a side view of the base and arm with counterbalance and raising/lowering mechanism of FIG. 5.
Figure 6B:
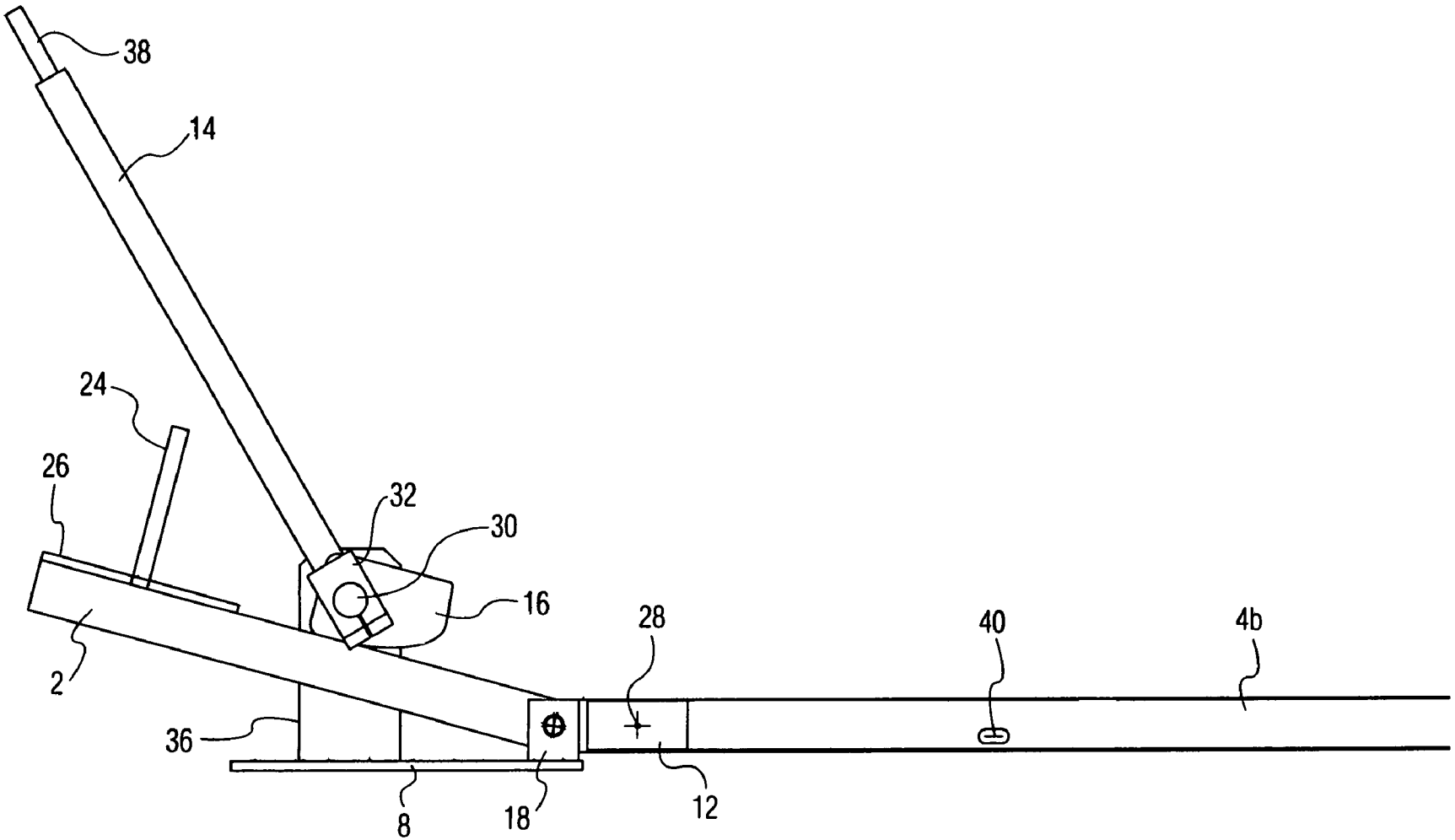

FIGS. 6A and 6B show a side view of the base and arm with counterbalance and raising/lowering mechanism of FIG. 5. For clarity, in FIGS. 6A and 6B, near riser 36 and ratchet catch 34 are not shown. FIG. 6A shows arm 2 mechanically coupled to arm extension 4*b*, with arm extension 4*b* in a raised position, while FIG. 6B shows arm extension 4*b* in a lowered position. As shown in FIG. 6A, the long axis of cam 16 may be substantially perpendicular to arm 2, causing arm 2 to be pushed toward base 8, thereby placing arm extension 4*b* in a raised position. As shown in FIG. 6B, when arm extension 4*b* is in a lowered position, the long axis of cam 14 may be substantially parallel to arm 2, and arm 2 may contact along the long axis of cam 16.

Arm extension 4*b* may have slot 40 which may interface with a corresponding pin (not shown) in arm extension 4*a* and which may allow both arm extensions 4*a* and 4*b* to be raised and lowered together using, for example, one or more raising/lowering mechanism 10.

In other aspects, raising/lowering mechanism 10 may be operated using any suitable mechanism, for example, electric motor, manually driven actuator, linear actuator, cam and follower, screw-jack, linkage, pneumatics, hydraulics, and control system.

Figure 7A:
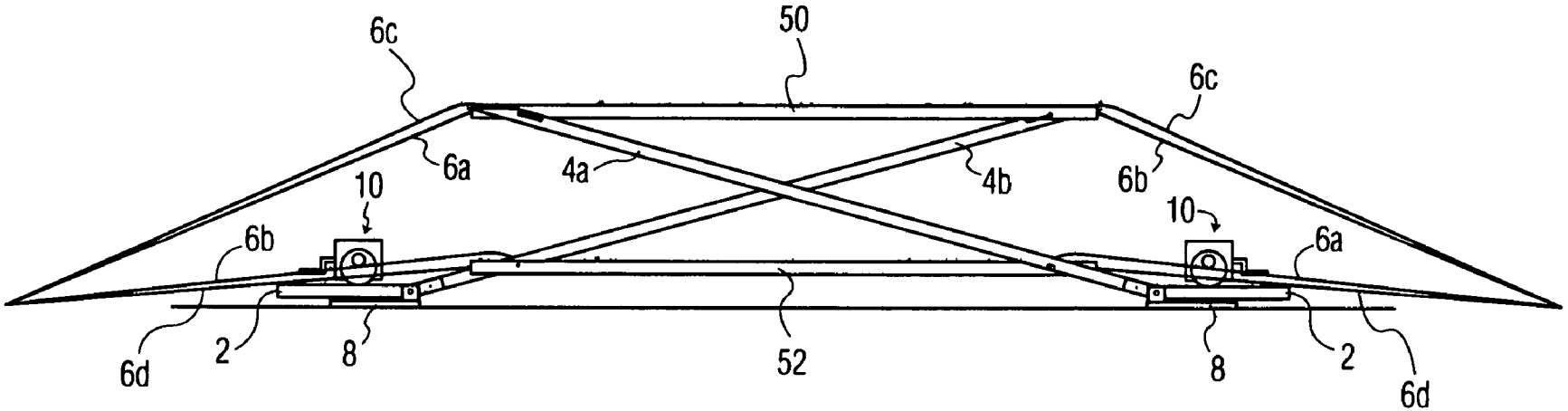
FIGS. 7A and 7B show front views of a vehicle barrier system, in raised and lowered positions, respectively, according to a second aspect of the present disclosure.
Figure 7B:
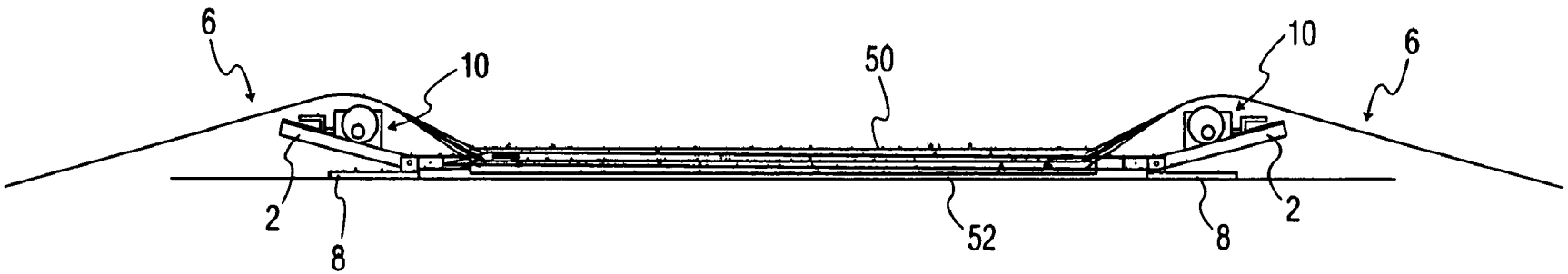

FIGS. 7A and 7B show front views of a vehicle barrier system, in raised and lowered positions, respectively, according to a second aspect of the present disclosure. This second aspect is similar to the first aspect shown in FIGS. 1A and 1B with the addition of top and bottom connecting arms and cables. Top connecting arm 50 may be mechanically coupled to at least one of arm extensions 4*a* and 4*b* using, for example, pin joint, pin-in-slot, roller-in-track, or transverse slider with pivot. Bottom connecting arm 52 may be mechanically coupled to at least one of arm extensions 4*a* and 4*b* at a point closer to bases 8 in a similar manner. Such mechanical couplings may allow top connecting arm 50 and bottom connecting arm 52 to collapse and fold along with arm extensions 4*a* and 4*b* when the system is in a lowered position as shown in FIG. 7B. Top connecting arm 50 may support cable 6*c* and bottom connecting arm 52 may support cable 6*d*. Cables 6*a*, 6*b*, 6*c*, and 6*d* may be mechanically coupled on either side to anchors 70 or energy absorbers 74 (shown in FIG. 9) using, for example, a heavy-duty D-link (not shown).

Top connecting arm 50 and bottom connecting arm 52 may provide additional rigidity and support and provide additional energy absorption when impacted by a vehicle. Arm extensions 4*a* and 4*b*, top connecting arm 50 and bottom connecting arm 52 may be scored on one or more sides to control deformation upon impact by a vehicle. As described above, top connecting arm 50 and bottom connecting arm 52 may be segmented and assembled in a manner similar to arm extensions 4*a* and 4*b*.

Figure 8C:
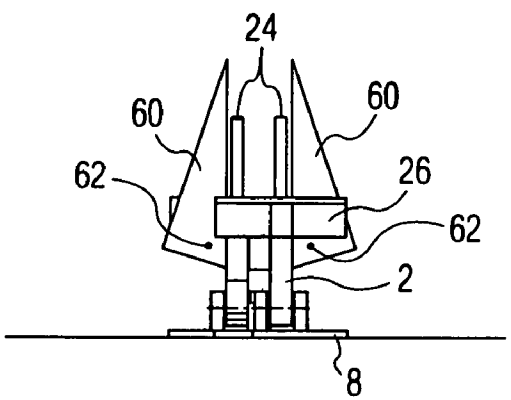
FIGS. 8A, 8B, and 8C show side views of the vehicle barrier system shown in FIGS. 7A and 7B with ramp and counterbalance.
Figure 8B:
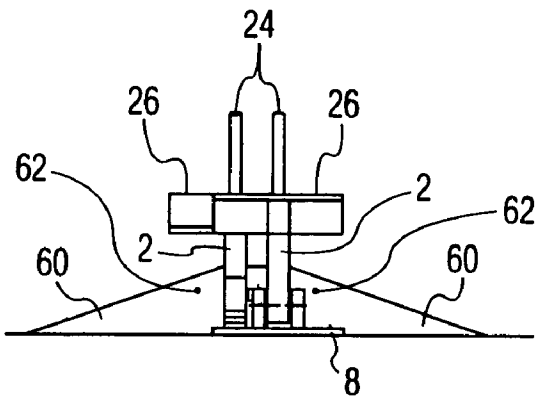
Figure 8A:
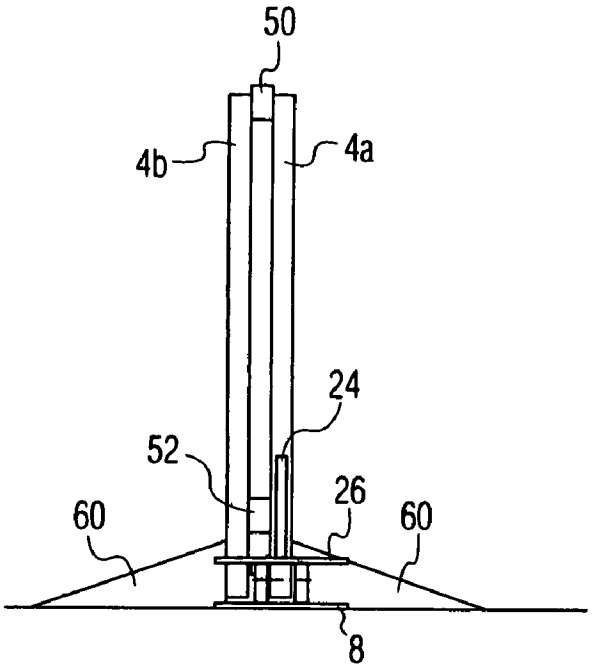

FIGS. 8A, 8B, and 8C show side views of the vehicle barrier system shown in FIGS. 7A and 7B with ramp and counterbalance. One or more ramps 60 may allow a vehicle to drive over the system when arm extensions 4*a* and 4*b*, top connecting arm 50 and bottom connecting arm 52 are in a lowered position. In one aspect, ramps 60 may be mechanically coupled to one or more bases 8 using, for example, hinges 62 (shown in FIGS. 8B and 8C), and may be raised, or folded-up, for transport. In FIG. 8A, the system may be set to stop a vehicle and shows arm extensions 4*a* and 4*b* raised and ramps 60 lowered. In FIG. 8B, the system may be set to allow a vehicle to pass over the system and shows arm extensions 4*a* and 4*b* lowered and ramps 60 lowered. In FIG. 8C, the system may be set for transport and shows arm extensions 4*a* and 4*b* lowered and ramps 60 raised. In another aspect, ramps 60 may not be mechanically coupled to the system.

Figure 9:
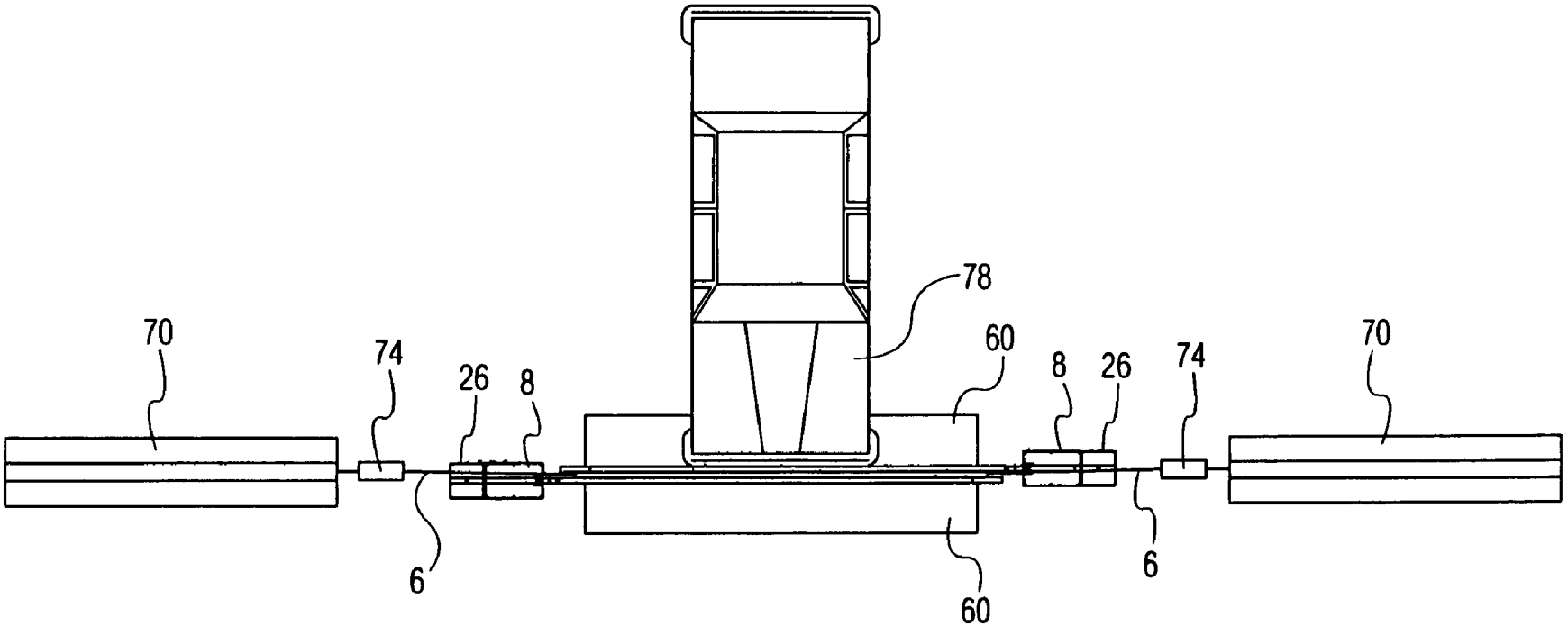
FIG. 9 shows a top view of the vehicle barrier system shown in FIGS. 7A and 7B, with ramp, energy absorbers, and anchors and before impact by a vehicle.
Figure 10:
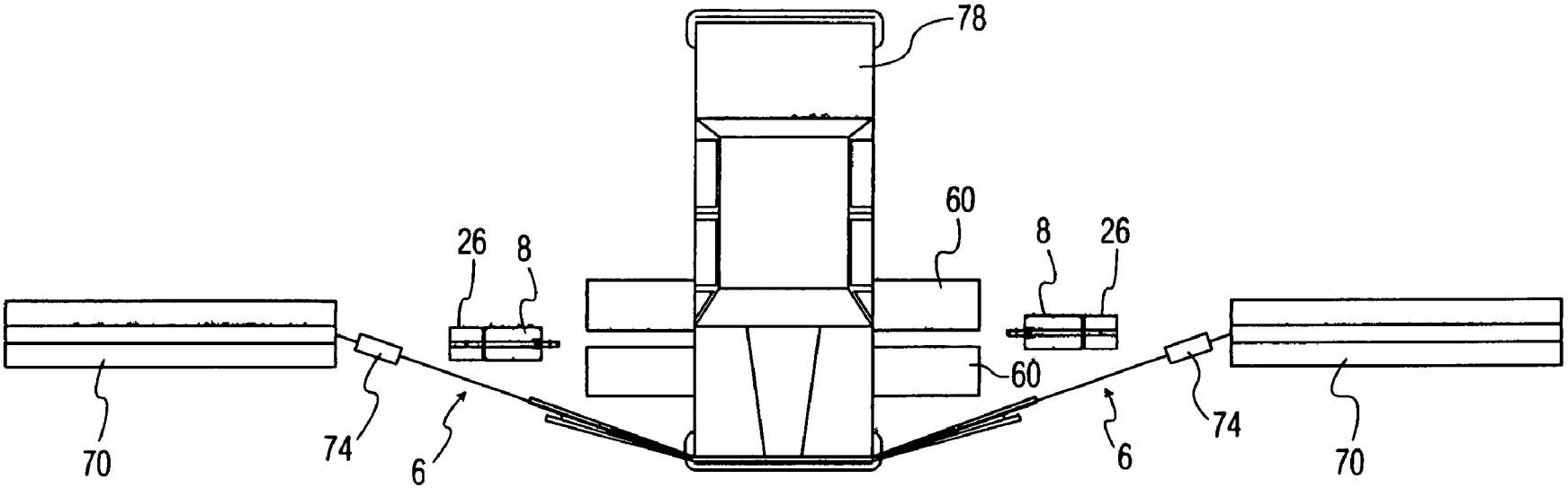
FIG. 10 shows a top view of the vehicle barrier system shown in FIGS. 7A and 7B, with ramp, energy absorbers, and anchors and after impact by a vehicle.
Figure 11:
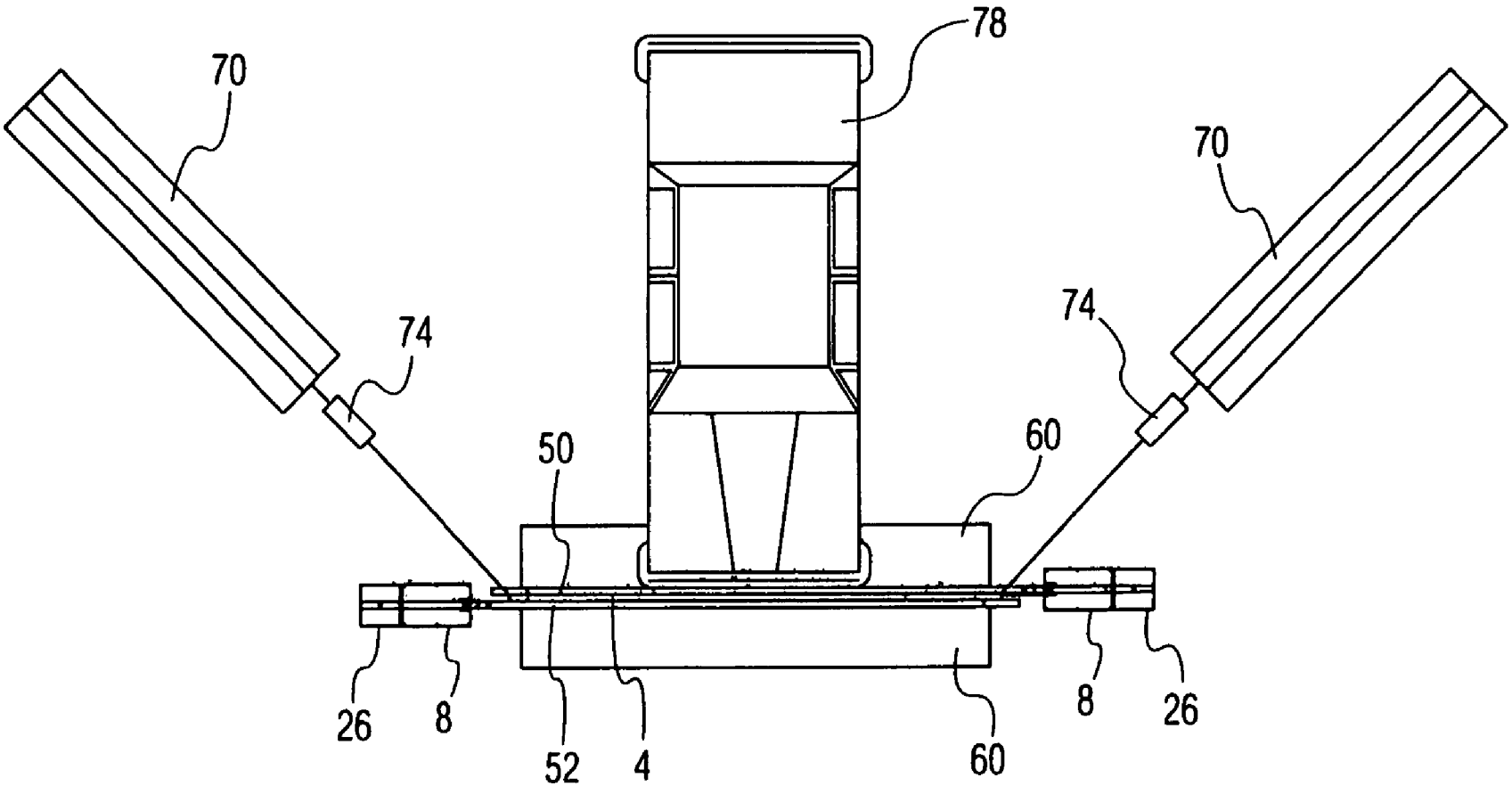
FIG. 11 shows a top view of the vehicle barrier system shown in FIGS. 7A and 7B, with ramp, energy absorbers, and alternate anchor placement and before impact by a vehicle.

FIGS. 9 and 10 show a top view of the vehicle barrier system shown in FIGS. 7A and 7B, with ramp, energy absorbers, and anchors before and after impact by a vehicle, respectively. Cables 6 may be mechanically coupled to anchors 70, via energy absorbers 74. As shown in FIG. 9, anchors 70 may be a Jersey barrier and may be placed in line with the impact plane. In another aspect, as shown in FIG. 11, anchors 70 may be placed behind and at an angle to the impact plane.

Anchors 70 may be anything that resists movement and may be, for example, a vehicle. Anchors 70 may also have energy absorbing qualities.

Energy absorbers 74 may include a dynamic braking system, one or more shear pins, springs, foams, pneumatics, hydraulics, woven cable or cloth, friction bearings, breakable concrete, crushable metals, force damping systems using viscous, coulomb or quadratic damping, mass acceleration systems in which mass is translated and/or rotated, or systems utilizing gravity or counterbalance weights.

In FIG. 9, vehicle 78 is at the impact plane, and in FIG. 10, vehicle 78 has passed the impact plane. As vehicle 78 passes through the impact plane, vehicle 78 may apply force to arm extensions 4*a* and 4*b*, top connecting arm 50, bottom connecting arm 52, and cables 6*a*, 6*b*, 6*c*, and 6*d*. Upon application of sufficient force, pin 28 may break or shear and arm extensions 4*a* and 4*b* may separate from arms 2. Arm extensions 4*a* and 4*b*, top connecting arm 50, bottom connecting arm 52 may deform and, in doing so, may absorb energy. Vehicle 78 may decelerate and energy may be transferred by cables 6*a*, 6*b*, 6*c*, and 6*d* to energy absorbers 74 and anchors 70, where it may be absorbed.

Figure 12:
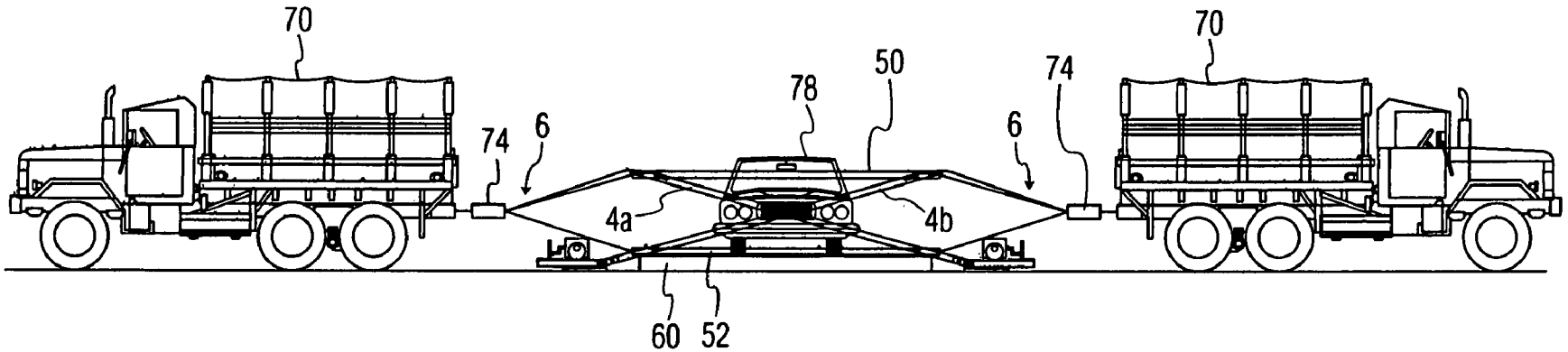
FIG. 12 shows a front view of the vehicle barrier system shown in FIGS. 7A and 7B, before impact by a vehicle, including ramp, energy absorbers and with trucks as anchors.

FIG. 12 shows a front view of the vehicle barrier system shown in FIGS. 7A and 7B, before impact by a vehicle, including ramp, energy absorbers and with trucks as anchors. In this aspect, energy absorbers 74 may be mechanically coupled to the frame of anchor vehicles 70 using, for example, a hitch. Anchor vehicles 70 may be placed in neutral or in gear, and wheel blocks or berms may be used to restrain anchor vehicles 70. In another aspect, multiple anchor vehicles 70 may be used as anchors on each side in series and/or in parallel.

Figure 13A:
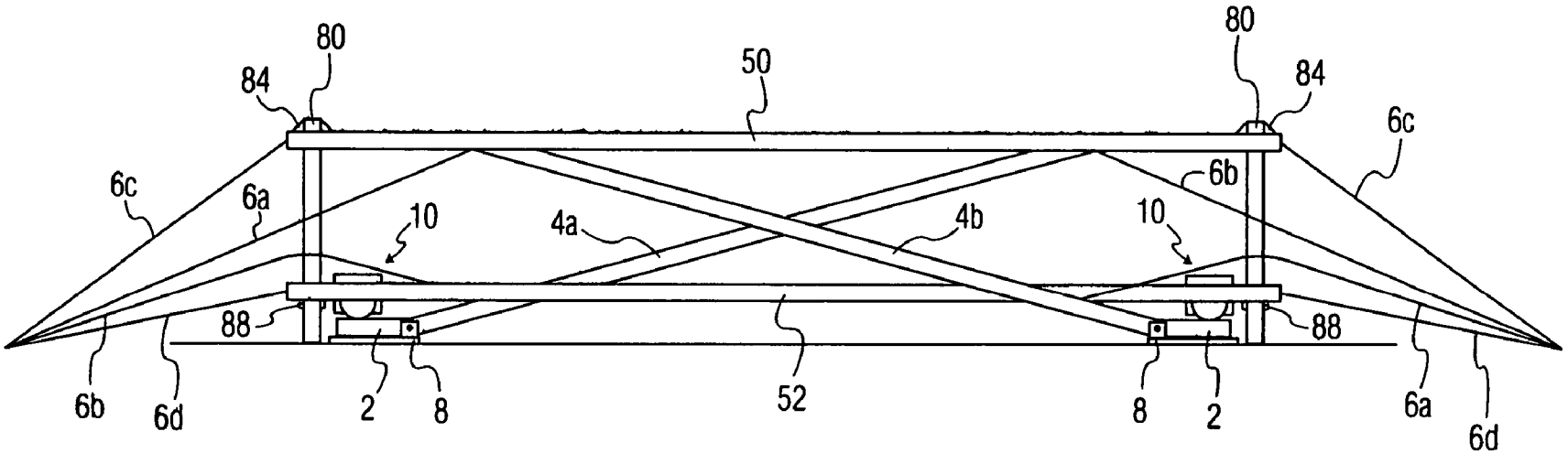
FIGS. 13A and 13B show front views of a vehicle barrier system, in raised and lowered positions, respectively, according to a third aspect of the present disclosure.
Figure 13B:
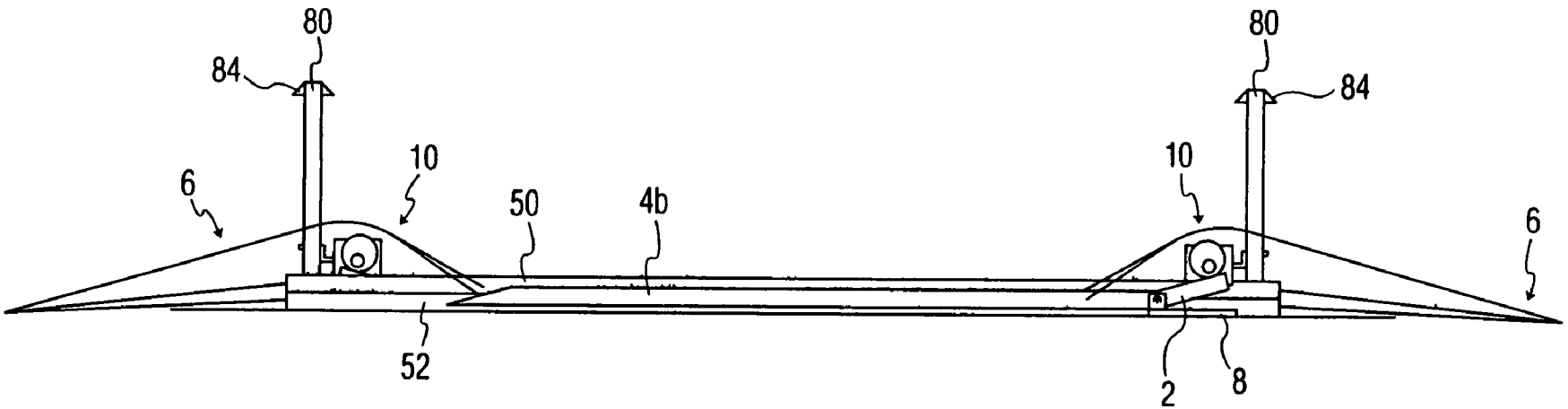

FIGS. 13A and 13B show front views of a vehicle barrier system, in raised and lowered positions, respectively, according to a third aspect of the present disclosure. This aspect is similar to the second aspect shown in FIGS. 7A and 7B with the addition of side arms and support brackets. Side arms 80 may be buried in the ground or may sit atop the ground on its own base (not shown). In another aspect, side arms 80 may be mechanically coupled to bases 8. Side arms 80 may be in contact with and may provide additional support for top connecting arm 50 and bottom connecting arm 52 and may also increase energy absorption upon vehicle impact. When in a raised position, as shown in FIG. 13A, top connecting arm 50 may be in mechanical communication with top bracket 84, and bottom connecting arm 52 may be in mechanical communication with bottom bracket 88.

Figure 14:
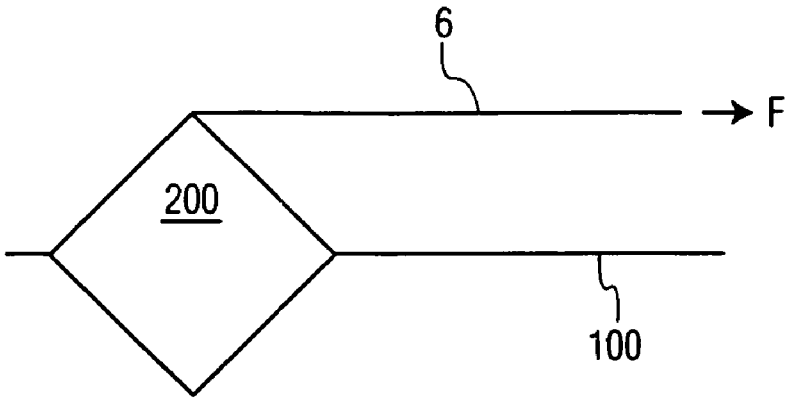
FIGS. 14-22 show side views of anchors according to aspects of the present disclosure.

FIG. 14 is a side view of an anchor and shows a square profile cube block 200 partially buried in ground surface 100, with cable 6 attached to block 200. Block 200 may be fabricated out of any material such that block 200 will be sufficiently heavy or otherwise provide enough resistance to require a force F to be applied to cable 6 to move block 200 from its position in ground surface 100. Additionally, ground surface 100 may be made out of any material such that it will provide enough resistance to prevent block 200 from moving without a force F being applied to cable 6. In one aspect, block 200 and ground surface 100 may be fabricated out of concrete. Block 200 may be placed at varying depths in ground surface 100, with a greater force F being required to move block 200 the further down it is buried.

Figure 15:
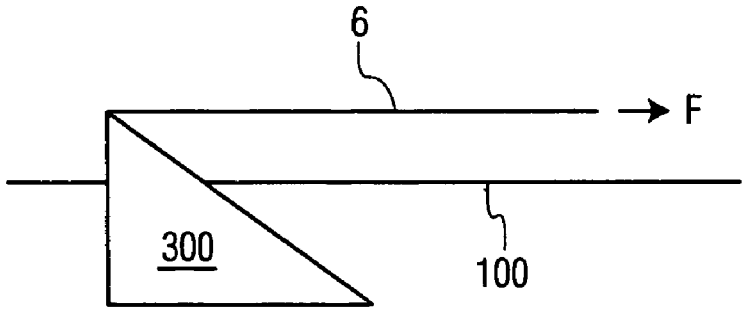

FIG. 15 is a side view of an anchor and shows a triangle profile block 300 partially buried in ground surface 100, with the hypotenuse of block 300 facing direction of cable 6. Block 300 may be fabricated out of any material such that the block will be sufficiently heavy or otherwise provide enough resistance to require a force F to be applied to cable 6 to move block 300 from its position in ground surface 100. Additionally, ground surface 100 may be made out of any material such that it will provide enough resistance to prevent block 300 from moving without a force F being applied to cable 6. In one aspect, block 300 and ground surface 100 may be fabricated out of concrete. Block 300 may be placed at varying depths in ground surface 100, with a greater force F being required to move block 300 the further down it is buried.

Figure 16:
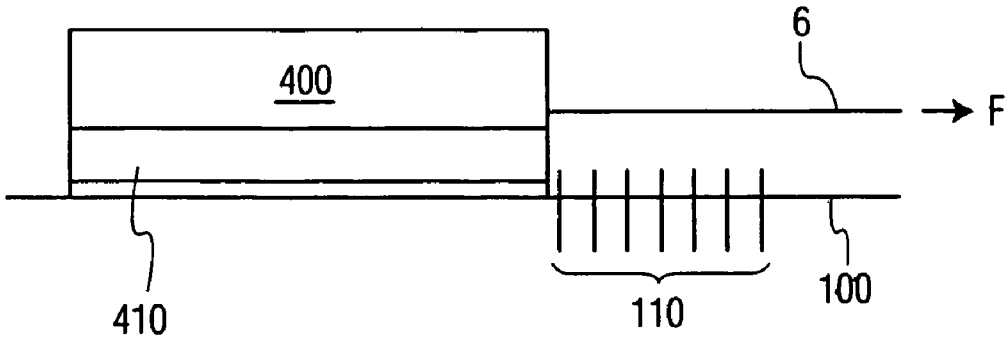

FIG. 16 is a side view of an anchor and shows block 400, having a rectangular profile, placed on a ground surface 100, with cable 6 attached to block 400. One or more of movable or deformable baffles 110 may be partially buried in ground surface 100 in the direction of cable 6. Baffles 110 may protrude from ground surface 100 to a height less than block 400. Block 400 may have an additional layer 410 of construction material that may provide additional protection during collision with baffles 110. Block 400 may be sufficiently heavy or otherwise provide enough resistance to require a force F to be applied to cable 6 to move block 400 through baffles 110. Baffles 110 may be of varying construction, and may provide enough resistance to require a force F to move block 400 through baffles 110. When a sufficient force F is applied to cable 6, block 400 may break, deflect, deform or otherwise sufficiently move baffles 110 to allow block 400 to move through baffles 110 in the direction in which the force F is applied. In one aspect, block 400 may be fabricated out of concrete, and baffles 110 may be fabricated out of metal or metal reinforced concrete.

Figure 17:
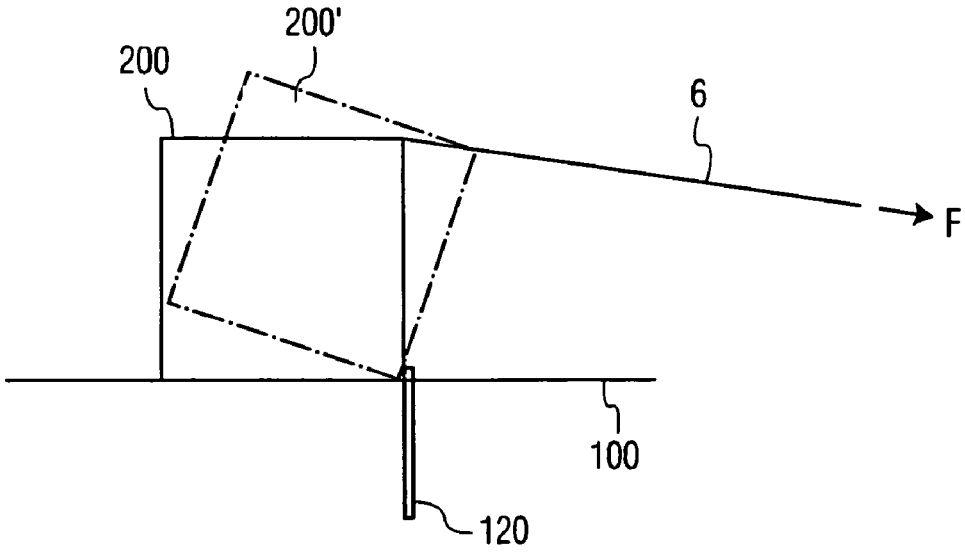

FIG. 17 is a side view of an anchor and shows a square profile block 200 placed on ground surface 100, with cable 6 attached to block 200. Curb 120 may be placed in ground surface 100 adjacent to block 200 in the direction of cable 6. Curb 120 may protrude from the ground surface 100 to a height less than the height of block 200. When a force F is applied to cable 6, block 200 may tip over curb 120 as shown using block 200', drawn in dashed lines. In one aspect, block 200 may be fabricated out of concrete and curb 120 may be fabricated out of metal or metal reinforced concrete. In another aspect, curb 120 may be replaced by two or more stakes arranged along a plane adjacent to block 200.

Figure 18:
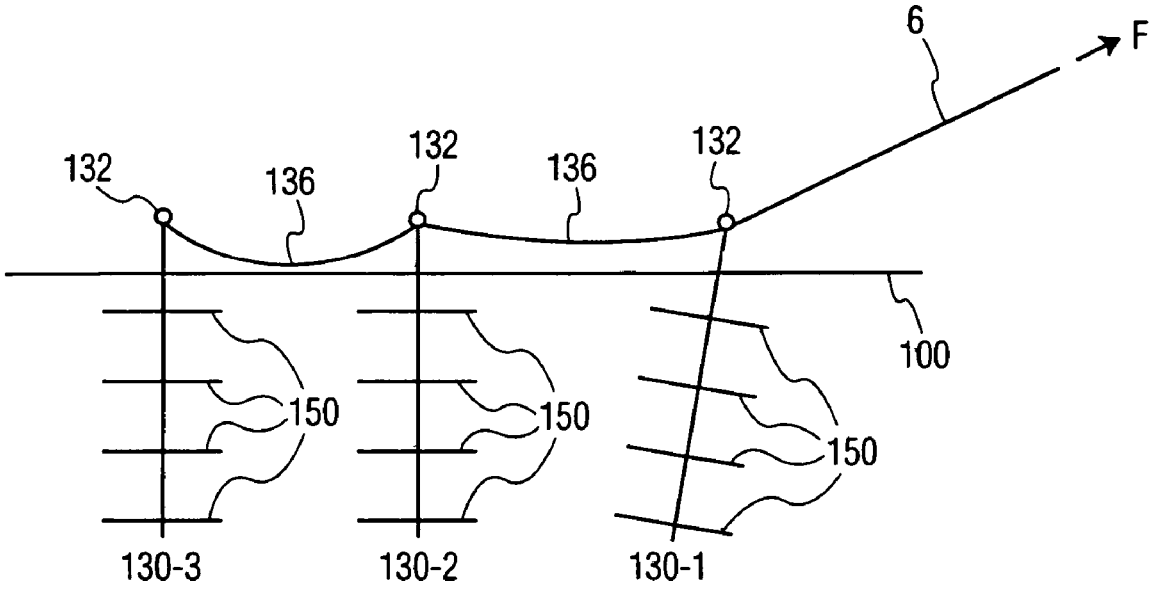

FIG. 18 is a side view of an anchor and shows stakes 130 at least partially buried in ground surface 100. Stakes 130 may have one or more flanges 150 which may extend at least partially substantially horizontally into ground surface 100. A portion of stakes 130 may protrude above or be accessible to ground surface 100 and may be linked to cable 136 using cable connections 132, such as a swage. Stakes 130 may be arranged in series as depicted in FIG. 18. Stake 130-1 may be connected to cable 6 via cable connection 132. When a force F is applied to cable 6, stakes 130 may be pulled from ground surface 100, with stake 130-1 closest to cable 6 pulled from the ground surface 100 first. Depending on the angle of the force F applied to cable 6, once force is applied, flanged stake 130-1 closest to cable 6 may tilt in the direction of the force F as depicted in FIG. 18. In one aspect, flanged stake 130 may be fabricated out of metal and ground surface 100 may be fabricated out of concrete. Flanges 150 may be hingably mechanically coupled to stake 130 and may fold inward toward stake 130 for transport and to ease insertion into ground surface 100. Flanges 150 may flare outward to provide additional resistance upon application of force to stake 130.

Figure 19:
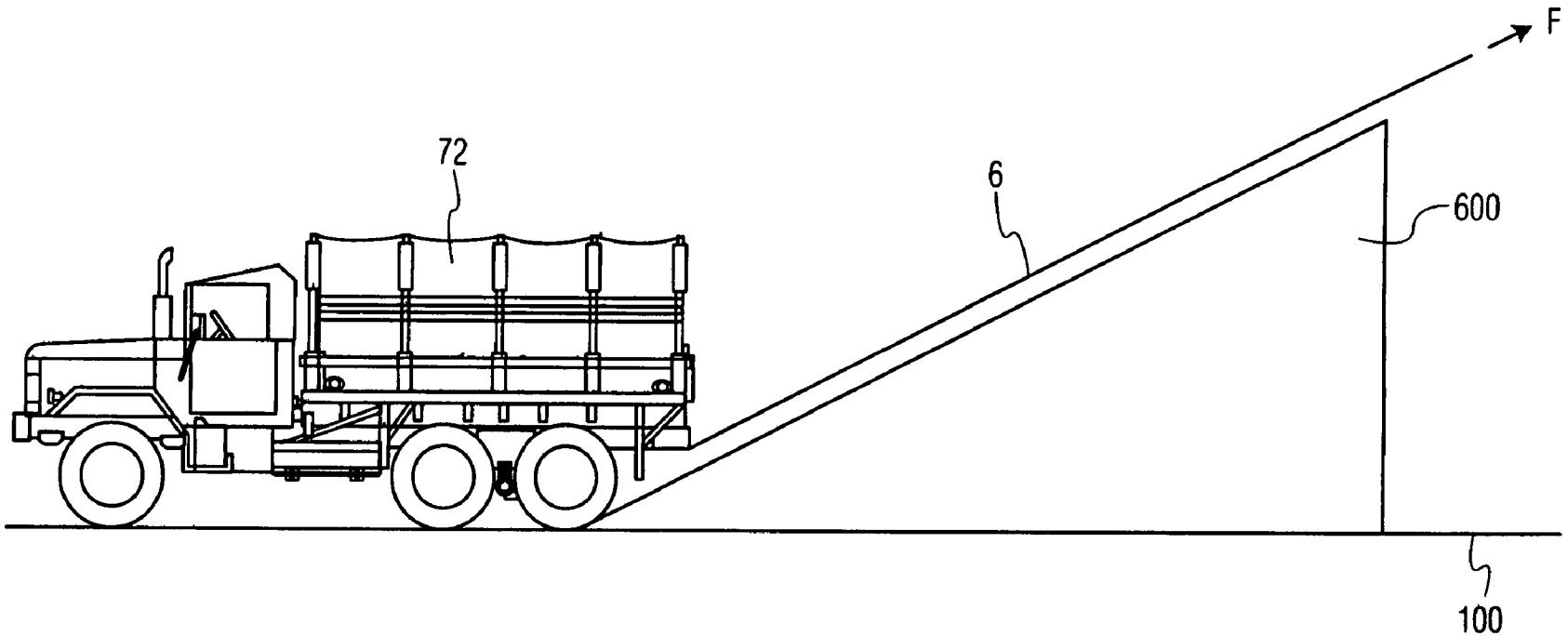

FIG. 19 is a side view of an anchor and shows anchor vehicle 72 on ground surface 100. Anchor vehicle 72 may be connected to cable 6. Anchor vehicle 72 may be placed at the bottom of ramp 600. Cable 6 may be extended from the rear of anchor vehicle 72 in a direction to the top of ramp 600. When a sufficient force F is applied to cable 6, anchor vehicle 72 may be pulled up ramp 600. Ramp 600 may be fabricated from any material and may be sufficiently anchored to ground surface 100 so as to not move when force F is applied to cable 6, or when anchor vehicle 72 moves up ramp 600. In one aspect, ramp 600 may be fabricated out of concrete.

Figure 20:
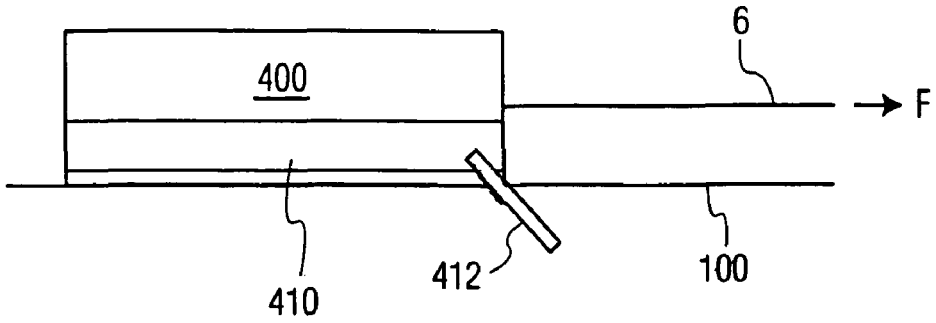

FIG. 20 is a side view of an anchor and shows block 400 on ground surface 100. Block 400 may be connected to cable 6. Plow 412 may extend downward at an angle and in a direction of force F from the base of block 400 into ground surface 100. Block 400 may have an additional layer 410 of protective construction material. Block 400 may be sufficiently heavy or may otherwise provide enough resistance to require a force F to be applied to cable 6 before block 400 moves in the direction of cable 6. When block 400 moves in the direction of cable 6, plow 412 may deform, break or become disconnected from either block 400 or ground surface 100.

Figure 21:
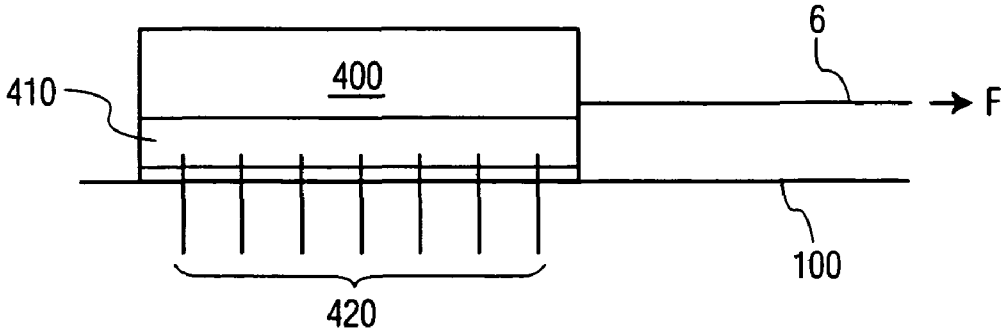

FIG. 21 is a side view of an anchor and shows block 400 on ground surface 100. Block 400 may be connected to cable 6. One or more substantially vertical protrusions 420 may extend from block 400 into ground surface 100. Block 400 may an additional layer 410 of protective construction material, and may be sufficiently heavy or may otherwise provide enough resistance to require a force F to be applied to cable 6 before block 400 moves in the direction of cable 6. When block 400 moves in the direction of cable 6, protrusions 420 may deform, break or become disconnected from either block 400 or ground surface 100.

Figure 22:
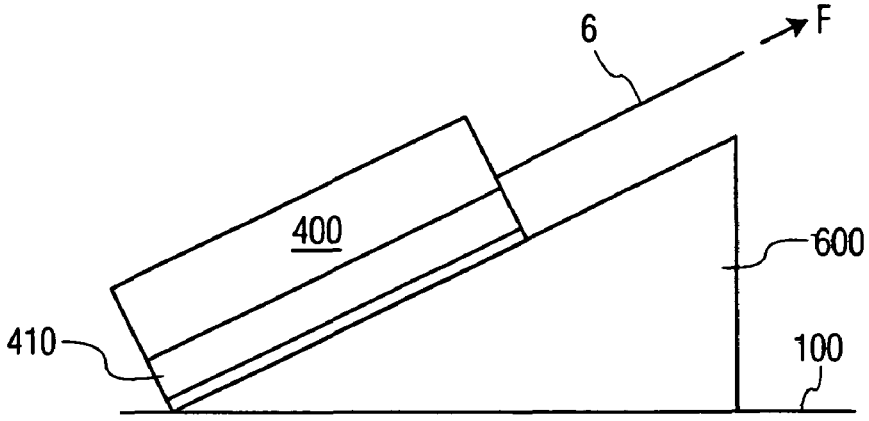

FIG. 22 is a side view of an anchor and shows a block 400 resting at the base of ramp 600. Ramp 600 rests on ground surface 100. Block 400 may be connected to cable 6. Block 400 may have an additional layer 410 of protective construction material and may be sufficiently heavy or otherwise may provide enough resistance to require a force F to be applied to cable 6 before block 400 moves in the direction of the cable 6. The cable 6 may be extended from block 400 in a direction up to the top of ramp 600. When a force F is applied to cable 6, block 400 may be pulled up the ramp 600. Ramp 600 may be made out of any material and may be sufficiently anchored to ground surface 100 so as to not move when the force F is applied to cable 6, or when block 400 moves up ramp 600.

Figure 23:
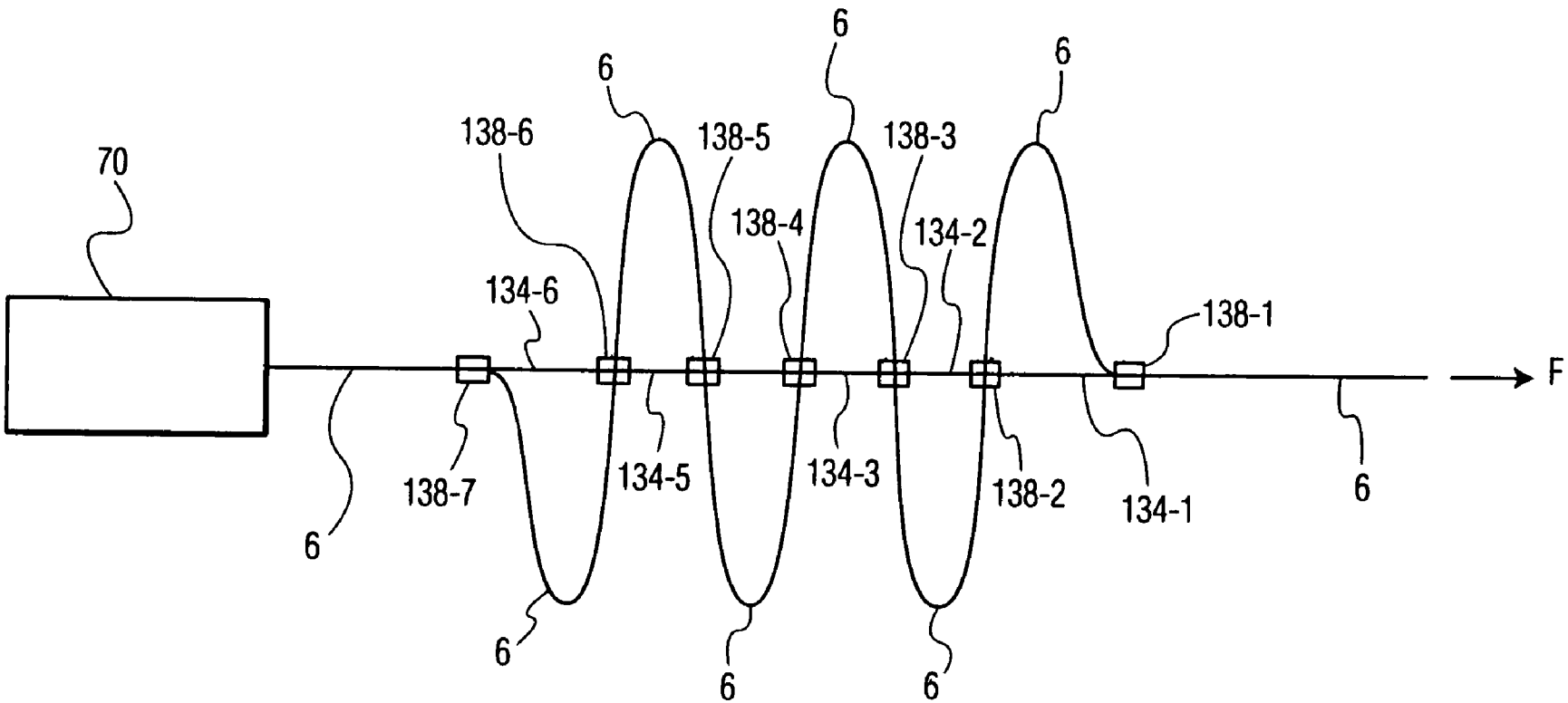
FIG. 23 shows a side view of an energy absorber and anchor according to an aspect of the present disclosure.

FIG. 23 shows a side view of an energy absorber using a cable. Cable 6 may attach at one end to anchor 70. Cable 6 may attach to cable ties 134 using cable clamps 138. When a force F is applied to cable 6, cable ties 134 or cable clamps 138 may break and cable 6 may unravel. Cable ties 134 or cable clamps 138 may be selected and arranged to break upon application of predetermined and possibly different forces. In one aspect, cable tie 134-1 may break upon application of less force than cable tie 134-2, and so on. Similarly, in another aspect, cable clamp 138-1 may break upon application of less force than cable clamp 138-2, and so on.

Although illustrative embodiments have been described herein in detail, it should be noted and will be appreciated by those skilled in the art that numerous variations may be made within the scope of this invention without departing from the principle of this invention and without sacrificing its chief advantages.

Unless otherwise specifically stated, the terms and expressions have been used herein as terms of description and not terms of limitation. There is no intention to use the terms or expressions to exclude any equivalents of features shown and described or portions thereof and this invention should be defined in accordance with the claims that follow.

What is claimed is:

1. A vehicle barrier system comprising:

a first base;

a first arm hingably mechanically coupled to the first base;

a raising/lowering mechanism in mechanical communication with the first arm; and a first cable in mechanical communication with the first arm, the first cable mechanically coupled to first and second anchors placed on opposite sides of an area through which a vehicle may pass, a second arm hingably mechanically coupled to a second base; and a second cable in mechanical communication with the second arm, the second cable mechanically coupled to the first and second anchors, wherein the first arm comprises a first portion frangibly mechanically coupled to a second portion, and the first and second portions are uncoupled upon application of at least a threshold force to one of the first and second portions, wherein the raising/lowering mechanism moves the first arm and the first cable between a first position and a second position, wherein the second arm and the second cable are moved between a first position and a second position, wherein the first base and first arm are arranged on a side opposite of the area through which a vehicle may pass from the second base and second arm, and wherein the first arm is mechanically coupled to the second arm, and the raising/lowering mechanism moves both the first and second arms.

2. A vehicle bather system comprising:

a first cable in mechanical communication with a first arm that is hingably mechanically coupled to a first base, which along with a first anchor, is located on a side of an area through which a vehicle may pass;

a second cable in mechanical communication with a second arm that is hingably mechanically coupled to a second base, which along with a second anchor, is located on another side of an area through which a vehicle may pass;

a first connecting arm mechanically coupled to each of the first and second arms; and a raising/lowering mechanism in mechanical communication with at least one of the first arm and the second arm, wherein the first and second cables are each mechanically coupled to each of the first and second anchors.

3. The vehicle barrier system of claim 2, wherein the raising/lowering mechanism moves at least a portion of the first and second arms, a portion of the first connecting arm, and at least a portion of the first and second cables between a first position and a second position, where the first position is at or below ground level and the second position is above ground level.

4. The vehicle barrier system of claim 2, further comprising:

a bottom connecting arm mechanically coupled to each of the first and second arms at a point along the first and second arms closer to the first and second bases.

5. The vehicle barrier system of claim 2, wherein the first arm comprises a first portion frangibly mechanically coupled to a second portion, and the first and second portions are uncoupled upon application of at least a threshold force to one of the first and second portions.

6. The vehicle barrier system of claim 5, wherein the second arm comprises a first portion frangibly mechanically coupled to a second portion, and the first and second portions are uncoupled upon application of at least a threshold force to one of the first and second portions.

7. The vehicle barrier system of claim 5, wherein the raising/lowering mechanism is in mechanical communication with the first portion of the first arm.

8. The vehicle bather system of claim 5, wherein the first cable is in mechanical communication with the second portion of the first arm.

9. The vehicle bather system of claim 2, wherein the first and second arms are formed of two or more separable segments.

10. The vehicle bather system of claim 4, wherein the first and bottom connecting arms are formed of two or more separable segments.

11. The vehicle bather system of claim 2, wherein, when in the second position, at least portions of the first and second arms, at least portions of the first and second cables, and at least a portion of the first connecting arm are high enough to encounter a front of a vehicle.

12. The vehicle barrier system of claim 2, wherein the first and second anchors are placed substantially along a plane formed by the first and second bases.

13. The vehicle bather system of claim 2, wherein the first and second anchors are placed at a predetermined angle to a plane formed by the first and second bases.

14. The vehicle bather system of claim 2, wherein at least a portion of the first and second arms are hollow and store at least a portion of the first and second cables, respectively.

15. The vehicle barrier system of claim 14, wherein the hollow portions of the first and second arms are accessible via a cover.

16. The vehicle barrier system of claim 2, wherein the first and second cables are mechanically coupled to one of a first anchor and a second anchor via an energy absorber.

17. The vehicle bather system of claim 2, wherein the third cable is mechanically coupled to one of a first anchor and a second anchor via an energy absorber.

18. The vehicle bather system of claim 16, wherein the energy absorber includes at least one of a dynamic braking system, shear pins, springs, foams, pneumatics, hydraulics, woven textile, friction bearings, breakable concrete, crushable metals, and counterbalance weights.

19. The vehicle bather system of claim 2, further comprising, a third cable mechanically coupled to the first and second anchors and in mechanical communication with the first connecting arm.

20. The vehicle barrier system of claim 4, further comprising, a fourth cable mechanically coupled to the first and second anchors and in mechanical communication with the bottom connecting arm.

21. The vehicle barrier system of claim 2, wherein at least a portion of the first connecting arm is hollow and stores at least a portion of the third cable.

22. The vehicle barrier system of claim 21, wherein the hollow portion of the first connecting arm is accessible via a cover.

23. The vehicle barrier system of claim 4, wherein at least a portion of the bottom connecting arm is hollow and stores at least a portion of the fourth cable.

24. The vehicle barrier system of claim 23, wherein the hollow portion of the bottom connecting arm is accessible via a cover.

25. A vehicle bather system comprising;

a first cable in mechanical communication with a first arm that is hingably mechanically coupled to a first base, which along with a first anchor, is located on a side of an area through which a vehicle may pass;

a second cable in mechanical communication with a second arm that is hingably mechanically coupled to a second base, which along with a second anchor, is located on another side of an area through which a vehicle may pass;

a top connecting arm mechanically coupled to each of the first and second arms;

a bottom connecting arm mechanically coupled to each of the first and second arms at a point along the first and second arms closer to the first and second bases;

a first side arm and a second side arm arranged on opposite sides of the area through which a vehicle may pass; and a raising/lowering mechanism in mechanical communication with at least one of the first arm and the second arm, wherein the first and second cables are each mechanically coupled to both the first and second anchors, wherein the raising/lowering mechanism moves the first and second arms, the first and second cables, and the top and bottom connecting arms between first and second positions, and wherein the first and second side arms are each in mechanical communication with the top and bottom connecting arms when in a second position.

26. The vehicle bather system of claim 25, further comprising, a third cable mechanically coupled to the first and second anchors and in mechanical communication with the first connecting arm; and a fourth cable mechanically coupled to the first and second anchors and in mechanical communication with the bottom connecting arm.

* * * * *